US012589432B2

(12) United States Patent
Franz et al.

(10) Patent No.: US 12,589,432 B2
(45) Date of Patent: Mar. 31, 2026

(54) DEVICE AND METHOD FOR PRODUCING AN INVESTMENT CASTING COMPONENT

(71) Applicant: ALD VACUUM TECHNOLOGIES GMBH, Hanau (DE)

(72) Inventors: Henrik Franz, Freigericht (DE); Sergejs Spitans, Nuremberg (DE); Björn Sehring, Bessenbach (DE)

(73) Assignee: ALD VACUUM TECHNOLOGIES GMBH, Hanau (DE)

( * ) Notice: Subject to any disclaimer, the term of this patent is extended or adjusted under 35 U.S.C. 154(b) by 0 days.

(21) Appl. No.: 18/691,608

(22) PCT Filed: Sep. 19, 2022

(86) PCT No.: PCT/EP2022/075889
§ 371 (c)(1),
(2) Date: Mar. 13, 2024

(87) PCT Pub. No.: WO2023/052161
PCT Pub. Date: Apr. 6, 2023

(65) Prior Publication Data

US 2024/0390974 A1 Nov. 28, 2024

(30) Foreign Application Priority Data

Sep. 28, 2021 (DE) ..... 10 2021 125 159.1

(51) Int. Cl.
*B22D 27/04* (2006.01)
*B22C 7/02* (2006.01)
(Continued)

(52) U.S. Cl.
CPC ..... *B22D 27/04* (2013.01); *B22C 7/02* (2013.01); *B22D 18/06* (2013.01); *B22D 35/06* (2013.01); *B22D 39/003* (2013.01)

(58) Field of Classification Search
CPC ..... B22D 18/06; B22D 27/04; B22D 27/045; B22D 39/003; F27D 11/06
See application file for complete search history.

(56) References Cited

U.S. PATENT DOCUMENTS 6,196,427 B1 * 3/2001 Carter, Jr. ..... B22D 23/10 75/10.24
6,446,701 B1 * 9/2002 Das ..... B22D 27/045 164/122.2
(Continued)

FOREIGN PATENT DOCUMENTS

CN 106756075 A 5/2017
CN 106890985 A * 6/2017
(Continued)

OTHER PUBLICATIONS

International Search Report dated Dec. 19, 2022, prepared in International Application No. PCT/EP2022/075889.
(Continued)

*Primary Examiner* — Kevin E Yoon
(74) *Attorney, Agent, or Firm* — Barnes & Thornburg LLP; Ryan L. Marshall

(57) ABSTRACT

The disclosure relates to a device for producing an investment casting component, comprising a melting chamber having an induction coil assembly disposed in the melting chamber, wherein the induction coil assembly is adapted to melt off an electrode at least partially received therein to produce a ceramic-free continuous melt jet having a melt flow rate MFR of at least 2.5 kg/min. The device further comprises a casting chamber downstream of the melting chamber and connected thereto, with an investment casting mold received or receivable therein for being filled by means of the ceramic-free, continuous melt jet.

20 Claims, 6 Drawing Sheets

(51) Int. Cl.

| | |
|---|---|
| ***B22D 18/06*** | (2006.01) |
| ***B22D 35/06*** | (2006.01) |
| ***B22D 39/00*** | (2006.01) |

(56) References Cited

U.S. PATENT DOCUMENTS

| | | | | |
|---|---|---|---|---|
| 2019/0366427 | A1* | 12/2019 | Franz | B22D 21/02 |
| 2021/0146431 | A1 | 5/2021 | Spitans et al. | |
| 2022/0330391 | A1 | 10/2022 | Spitans et al. | |
| 2022/0339701 | A1 | 10/2022 | Güther et al. | |

FOREIGN PATENT DOCUMENTS

| | | | | |
|---|---|---|---|---|
| CN | 107962169 | A * | 4/2018 | B22D 27/045 |
| CN | 111254398 | A | 6/2020 | |
| CN | 213841739 | U * | 7/2021 | |
| DE | 102018109592 | A1 | 10/2019 | |
| DE | 102019121998 | A1 | 2/2021 | |
| DE | 102019214555 | A1 | 3/2021 | |
| EP | 0116221 | A1 | 8/1984 | |
| EP | 0545097 | A2 | 6/1993 | |
| EP | 1045216 | A2 | 10/2000 | |
| EP | 2606994 | A2 | 6/2013 | |
| EP | 3556487 | A1 | 10/2019 | |

OTHER PUBLICATIONS

International Preliminary Report on Patenability Report dated May 10, 2023, prepared in International Application No. PCT/EP2022/075889.

* cited by examiner

DEVICE AND METHOD FOR PRODUCING AN INVESTMENT CASTING COMPONENT

CROSS-REFERENCE TO RELATED APPLICATIONS

This application is a National Stage application of International Application No. PCT/EP2022/075889, filed Sep. 19, 2022. This application also claims priority under 35 U.S.C. § 119 to German Patent Application No. 10 2021 125 159.1, filed Sep. 29, 2021.

The present disclosure relates to a device and a method for producing an investment casting component by use of a ceramic-free continuous melt jet. In other words, the disclosure relates to a device and a method for investment casting of molded parts.

BACKGROUND OF THE DISCLOSURE

Investment casting plants and investment casting processes carried out therewith are used to produce cast components made of metal alloys with comparatively high surface quality and dimensional accuracy. For example, investment casting plants and processes can be used to produce components for the aerospace industry, the power generation industry, the automotive industry, the medical technology, the chemical industry and/or the electrical industry. Components manufactured by use of investment casting processes require minimal post-processing. In addition, investment casting processes can be used to produce components with complex structures.

In known investment casting plants, material to be melted is melted in a crucible and then poured into a prepared melt mold. However, in known investment casting plants, undesirable impurities can occur in the molten material, which negatively affects the quality of the cast component produced.

It is therefore an object of the disclosure to provide a device and a method which overcome the disadvantages of the prior art.

Furthermore, it is an object of the disclosure to provide a device and a method that enable the production of investment casting components with improved quality. Improved quality here can mean, for example, a higher material purity and/or a higher surface quality of the component.

This object is achieved by the subject-matter of the independent claims. Further developments and embodiments of the device and the method are subject-matter of the dependent claims and the following description.

DESCRIPTION OF THE DISCLOSURE

One aspect of the disclosure relates to a device or plant for producing investment casting components, such as complex cast parts. The device includes a melting chamber comprising an induction coil assembly disposed in the melting chamber. The induction coil assembly is adapted to melt an electrode received at least in part therein to produce a ceramic-free continuous melt jet with a melt flow rate (MFR) of at least 2.5 kg/min. The device further comprises a casting chamber downstream of and connected to the melting chamber and comprising an investment casting mold received or receivable therein and adapted to be filled by means of the ceramic-free continuous melt jet.

The generation and use of a ceramic-free, continuous melt jet can prevent contamination of the melt during the process, which serves both to improve the mold filling process and to improve the metallurgical properties of the cast part produced.

By generating and using a continuous melt jet, a less turbulent mold filling process can be realized. This reduces the occurrence of ceramic impurities in the melt material and thus in the investment casting due to particles dislodged from the mold wall. In addition, a continuous and uniform filling of the mold allows possible contaminating particles to be carried upward during the casting process, where they are less likely to affect the quality of the cast part.

The induction coil assembly can be designed to melt the electrode received at least partially therein in such a way that it generates a ceramic-free, continuous melt jet with a melt flow rate MFR of at least 4 kg/min, such as at least 5 kg/min, such as at least 6 kg/min, such as at least 8 kg/min.

The induction coil assembly can be designed to melt the electrode received therein at least partially in such a way that it generates a ceramic-free, continuous melt jet with a melt flow rate MFR of at most 15 kg/min, such as at most 12 kg/min, such as at most 10 kg/min.

In some implementations, the induction coil assembly can be designed to melt the electrode received therein at least partially in such a way that it generates a ceramic-free, continuous melt jet with a melt flow rate MFR of between 2.5 kg/min and 10 kg/min.

The melt flow rate MFR of at least 2.5 kg/min, such as in the range between 2.5 kg/min and 10 kg/min, as determined by the inventors, represents a melt flow rate suitable for investment casting applications, which represents an optimal balance between ensuring sufficient superheating of the melt jet, achieving an appropriate mold filling time and an energy consumption acceptable in practice.

Furthermore, the inventors of the present disclosure have recognized that sufficient superheating of the melt jet can be realized at a melt flow rate MFR of at least 2.5 kg/min.

Such a surprising relationship between the melt flow rate MRF and superheating was not expected based on the prior art known from practice. Rather, it would have been expected that only a very low superheating could be achieved due to a relatively short dwell time of the melted material within the coil arrangement resulting from an increased melt flow rate. However, sufficiently high superheating of a melt is required for investment casting applications in order to prevent solidification and clumping of the melt before it is introduced into the mold. At the same time, in investment casting, complete filling within a reasonable mold filling time must be ensured in order to produce an investment casting component with the required quality and grade.

Due to the melt flow rate of at least 2.5 kg/min, such as in the range between 2.5 kg/min and 10 kg/min, of the continuous melt jet generated by means of the device, it can be achieved that the investment casting mold is completely filled in a reasonable time. In other words, the minimum melt flow rate provided by the inventors can reduce the mold filling time to an optimum level. At lower melt flow rates, such as those known from conventional continuous melting processes, it would not be possible to ensure adequate mold filling and thus production of an investment casting component of sufficient quality. In some implementations, the adequate mold filling time may refer to a mold filling time for common investment casting components in the aerospace industry—for example turbine blades, the power generation industry—for example turbine blades, the automotive industry—for example turbocharger wheels, the medical technology, the chemical and/or electrical industry.

The minimum melt flow rate envisaged by the inventors may thus be particularly suitable for the production of such investment casting components of high quality, without being limited thereto.

The investment casting mold is a lost mold. The material of the investment casting mold may be, for example, ceramic or graphite.

In some implementations, the meltable electrode may be a rotating electrode suspended vertically in the melting chamber and continuously melted off under vacuum or under an inert gas atmosphere by means of a controlled motion at a lower end by means of the induction coil assembly. The controlled motion may include, in addition to the rotational motion for uniform melting, continuous feeding the electrode toward the casting chamber.

The induction coil assembly may comprise a tapered shape tapering toward the lower end of the electrode. The induction coil assembly and the electrode are arranged coaxially with respect to each other.

In one embodiment, the casting chamber may include a mold heater configured to heat the investment casting mold during casting or during the production process. This can prevent premature and undesired cooling and thus solidification of the melt jet introduced into the investment casting mold. This can contribute to ensure that the investment casting mold is completely filled and the quality of the produced investment casting component is further increased.

The device may include a mold extractor by means of which the investment casting mold can be extracted in a direction away from the melting chamber. The mold extractor may be located in or at or below the casting chamber. For example, the mold extractor may be mounted in a load/unload chamber. By means of the mold extractor, controlled solidification of the cast part can be achieved. Hereby, a feeding or refilling of liquid metal from an upper part of the mold, to which the melt jet is fed, to areas of the mold that become free due to solidification shrinkage can be enabled. Moreover, directionally solidified castings can be produced by means of the mold extractor and the controlled solidification.

The device may include a load/unload chamber for loading unloading the investment casting mold. The load/unload chamber is located downstream of the casting chamber.

The induction coil assembly may be operated with a power P for which the following conditions are satisfied:

$$P\,[\mathrm{kW}] \geq 5\left[\mathrm{kW}\cdot\frac{\mathrm{min}}{\mathrm{kg}}\right]\cdot MFR,$$

such as $$P\,[\mathrm{kW}] \geq 15\left[\mathrm{kW}\cdot\frac{\mathrm{min}}{\mathrm{kg}}\right]\cdot MFR,$$

such as $$P\,[\mathrm{kW}] \geq 50\left[\mathrm{kW}\cdot\frac{\mathrm{min}}{\mathrm{kg}}\right]\cdot MFR,$$

such as $$P\,[\mathrm{kW}] \geq 125\left[\mathrm{kW}\cdot\frac{\mathrm{min}}{\mathrm{kg}}\right]\cdot MFR.$$

The induction coil assembly may be operated with a power P for which the following conditions are satisfied:

$$P\,[\mathrm{kW}] \leq 600\left[\mathrm{kW}\cdot\frac{\mathrm{min}}{\mathrm{kg}}\right]\cdot MFR,$$

-continued such as $$P\,[\mathrm{kW}] \leq 300\left[\mathrm{kW}\cdot\frac{\mathrm{min}}{\mathrm{kg}}\right]\cdot MFR,$$

such as $$P\,[\mathrm{kW}] \leq 100\left[\mathrm{kW}\cdot\frac{\mathrm{min}}{\mathrm{kg}}\right]\cdot MFR,$$

such as $$P\,[\mathrm{kW}] \leq 35\left[\mathrm{kW}\cdot\frac{\mathrm{min}}{\mathrm{kg}}\right]\cdot MFR.$$

The induction coil assembly can be operated with a power P for which the following conditions are satisfied:

$$5\left[\mathrm{kW}\cdot\frac{\mathrm{min}}{\mathrm{kg}}\right]\cdot MFR \leq P\,[\mathrm{kW}] \leq 600\left[\mathrm{kW}\cdot\frac{\mathrm{min}}{\mathrm{kg}}\right]\cdot MFR,$$

such as $$15\left[\mathrm{kW}\cdot\frac{\mathrm{min}}{\mathrm{kg}}\right]\cdot MFR \leq P\,[\mathrm{kW}] \leq 125\left[\mathrm{kW}\cdot\frac{\mathrm{min}}{\mathrm{kg}}\right]\cdot MFR,$$

such as $$17.5\left[\mathrm{kW}\cdot\frac{\mathrm{min}}{\mathrm{kg}}\right]\cdot MFR \leq P\,[\mathrm{kW}] \leq 90\left[\mathrm{kW}\cdot\frac{\mathrm{min}}{\mathrm{kg}}\right]\cdot MFR,$$

such as $$20\left[\mathrm{kW}\cdot\frac{\mathrm{min}}{\mathrm{kg}}\right]\cdot MFR \leq P\,[\mathrm{kW}] \leq 30\left[\mathrm{kW}\cdot\frac{\mathrm{min}}{\mathrm{kg}}\right]\cdot MFR.$$

The power P can be set as a function of a diameter of the electrode to be melted off according to the above conditions.

The induction coil assembly can, such as for melting off an electrode with a diameter of 150 mm, be operated with a power P for which the following conditions are satisfied:

$$P\,[\mathrm{kW}] \geq 15\left[\mathrm{kW}\cdot\frac{\mathrm{min}}{\mathrm{kg}}\right]\cdot MFR,$$

such as $$P\,[\mathrm{kW}] \geq 17.5\left[\mathrm{kW}\cdot\frac{\mathrm{min}}{\mathrm{kg}}\right]\cdot MFR,$$

such as $$P\,[\mathrm{kW}] \geq 20\left[\mathrm{kW}\cdot\frac{\mathrm{min}}{\mathrm{kg}}\right]\cdot MFR,$$

such as $$P\,[\mathrm{kW}] \geq 22.5\left[\mathrm{kW}\cdot\frac{\mathrm{min}}{\mathrm{kg}}\right]\cdot MFR.$$

The induction coil assembly can, such as for melting off an electrode with a diameter of 150 mm, be operated with a power P for which the following conditions are satisfied:

$$P\,[\mathrm{kW}] \leq 50\left[\mathrm{kW}\cdot\frac{\mathrm{min}}{\mathrm{kg}}\right]\cdot MFR,$$

such as $$P\,[\mathrm{kW}] \leq 40\left[\mathrm{kW}\cdot\frac{\mathrm{min}}{\mathrm{kg}}\right]\cdot MFR,$$

such as

-continued $$P\,[\mathrm{kW}] \leq 35\left[\mathrm{kW}\cdot\frac{\mathrm{min}}{\mathrm{kg}}\right]\cdot MFR,$$

such as $$P\,[\mathrm{kW}] \leq 30\left[\mathrm{kW}\cdot\frac{\mathrm{min}}{\mathrm{kg}}\right]\cdot MFR.$$

The induction coil assembly may be operated with a power P of 400 kW or less, such as 350 kW or less, such as 300 kW or less.

The aforementioned powers P with which the induction coil assembly or induction coil may be supplied or operated can contribute to optimize the power consumption and voltage of the device, while ensuring the balance with an appropriate mold filling time and the optimal superheating.

The induction coil assembly may be set up to superheat the melt jet as a function of the melt flow rate MFR such that the superheating temperature $T_{sup}$ satisfies the following conditions:

$$T_{sup}[^\circ\,\mathrm{C.}] \geq 5\left[^\circ\,\mathrm{C.}\cdot\frac{\mathrm{min}}{\mathrm{kg}}\right]\cdot MFR,$$

such as $$T_{sup}[^\circ\,\mathrm{C.}] \geq 45\left[^\circ\,\mathrm{C.}\cdot\frac{\mathrm{min}}{\mathrm{kg}}\right]\cdot MFR,$$

such as $$T_{sup}[^\circ\,\mathrm{C.}] \geq 100\left[^\circ\,\mathrm{C.}\cdot\frac{\mathrm{min}}{\mathrm{kg}}\right]\cdot MFR,$$

such as $$T_{sup}[^\circ\,\mathrm{C.}] \geq 270\left[^\circ\,\mathrm{C.}\cdot\frac{\mathrm{min}}{\mathrm{kg}}\right]\cdot MFR.$$

The induction coil assembly may be set up to superheat the melt jet as a function of the melt flow rate MFR such that the superheating temperature $T_{sup}$ satisfies the following conditions:

$$T_{sup}[^\circ\,\mathrm{C.}] \leq 600\left[^\circ\,\mathrm{C.}\cdot\frac{\mathrm{min}}{\mathrm{kg}}\right]\cdot MFR,$$

such as $$T_{sup}[^\circ\,\mathrm{C.}] \leq 400\left[^\circ\,\mathrm{C.}\cdot\frac{\mathrm{min}}{\mathrm{kg}}\right]\cdot MFR,$$

such as $$T_{sup}[^\circ\,\mathrm{C.}] \leq 250\left[^\circ\,\mathrm{C.}\cdot\frac{\mathrm{min}}{\mathrm{kg}}\right]\cdot MFR,$$

such as $$T_{sup}[^\circ\,\mathrm{C.}] \leq 100\left[^\circ\,\mathrm{C.}\cdot\frac{\mathrm{min}}{\mathrm{kg}}\right]\cdot MFR.$$

The induction coil assembly can be set up to superheat the melting jet as a function of the melt flow rate MFR in such a way that the superheating temperature $T_{sup}$ satisfies the following conditions:

$$5\left[^\circ\,\mathrm{C.}\cdot\frac{\mathrm{min}}{\mathrm{kg}}\right]\cdot MFR \leq T_{sup}\ [^\circ\,\mathrm{C.}] \leq 600\left[^\circ\,\mathrm{C.}\cdot\frac{\mathrm{min}}{\mathrm{kg}}\right]\cdot MFR,$$

-continued $$\text{such as } 7\left[^\circ\,\mathrm{C.}\cdot\frac{\mathrm{min}}{\mathrm{kg}}\right]\cdot MFR \leq T_{sup}\ [^\circ\,\mathrm{C.}] \leq 400\left[^\circ\,\mathrm{C.}\cdot\frac{\mathrm{min}}{\mathrm{kg}}\right]\cdot MFR,$$

$$\text{such as } 25\left[^\circ\,\mathrm{C.}\cdot\frac{\mathrm{min}}{\mathrm{kg}}\right]\cdot MFR \leq T_{sup}\ [^\circ\,\mathrm{C.}] \leq 250\left[^\circ\,\mathrm{C.}\cdot\frac{\mathrm{min}}{\mathrm{kg}}\right]\cdot MFR,$$

$$\text{such as } 10\left[^\circ\,\mathrm{C.}\cdot\frac{\mathrm{min}}{\mathrm{kg}}\right]\cdot MFR \leq T_{sup}\ [^\circ\,\mathrm{C.}] \leq 100\left[^\circ\,\mathrm{C.}\cdot\frac{\mathrm{min}}{\mathrm{kg}}\right]\cdot MFR.$$

The superheating temperature $T_{sup}$ can be set as a function of a diameter of the electrode to be melted off according to the above conditions.

The induction coil assembly can be set up, such as for melting off an electrode with a diameter of 150 mm, to superheat the melt jet as a function of the melt flow rate MFR in such a way that the superheating temperature $T_{sup}$ satisfies the following conditions:

$$T_{sup}\ [^\circ\,\mathrm{C.}] \geq 5\left[^\circ\,\mathrm{C.}\cdot\frac{\mathrm{min}}{\mathrm{kg}}\right]\cdot MFR,$$

$$\text{such as } T_{sup}\ [^\circ\,\mathrm{C.}] \geq 6,5\left[^\circ\,\mathrm{C.}\cdot\frac{\mathrm{min}}{\mathrm{kg}}\right]\cdot MFR,$$

$$\text{such as } T_{sup}\ [^\circ\,\mathrm{C.}] \geq 7,9\left[^\circ\,\mathrm{C.}\cdot\frac{\mathrm{min}}{\mathrm{kg}}\right]\cdot MFR.$$

The induction coil assembly can be set up to superheat the melt jet by at least 10° C., such as by at least 20° C., such as by at least 40° C., such as by at least 60° C., such as by at least 80° C. Superheating of more than 100° C. can also be achieved.

The induction coil assembly can be set up, such as for melting off an electrode with a diameter of 150 mm, to superheat the melt jet as a function of the melt flow rate MFR in such a way that the superheating temperature $T_{sup}$ satisfies the following conditions:

$$T_{sup}\ [^\circ\,\mathrm{C.}] \leq 25\left[^\circ\,\mathrm{C.}\cdot\frac{\mathrm{min}}{\mathrm{kg}}\right]\cdot MFR,$$

$$\text{such as } T_{sup}\ [^\circ\,\mathrm{C.}] \leq 20\left[^\circ\,\mathrm{C.}\cdot\frac{\mathrm{min}}{\mathrm{kg}}\right]\cdot MFR,$$

$$\text{such as } T_{sup}\ [^\circ\,\mathrm{C.}] \leq 15\left[^\circ\,\mathrm{C.}\cdot\frac{\mathrm{min}}{\mathrm{kg}}\right]\cdot MFR.$$

The superheating here may be a superheating of the melt jet averaged over time and volume.

The induction coil assembly may be set up to superheat the melt jet by 250° C. or less, such as 200° C. or less, such as 150° C. or less. The superheating can be adjusted depending on the material (with respect to the electrode).

Said superheating of the melt jet can ensure an optimization of the balance between the energy consumption and voltage of the device, the appropriate mold filling time and the optimal superheating. In some implementations, the specified superheating as a function of melt flow rate can provide a measure by means of which the quality of the investment casting components can be further improved.

The induction coil assembly may be operated with a voltage of 1200 V or less, such as 1000 V or less. The voltage may be at least 100 V, such as at least 200 V, such as at least 450 V. This upper voltage limit of 1000 V allows the plant to be operated in the low-voltage range. Also, at such a voltage, for example, any insulation between the windings of the induction coil can be dispensed with.

In alternative embodiments, however, higher voltages are also possible for energizing the induction coil assembly. In some implementations, a higher voltage, for example of 1500 V or more, may be provided when the plant is operated under elevated pressure.

The induction coil assembly may be operated at a frequency between 10 kHz and 300 kHz, such as between 50 kHz and 200 kHz, such as between 75 kHz and 125 kHz. In some implementations, a frequency may be 100 kHz.

At least the melting chamber may be pressurized with an absolute pressure so that the melt jet is generated under this absolute pressure. The absolute pressure may be at least 30 mbar, such as at least 1 bar, such as at least 5 bar. The absolute pressure may be less than 10 bar. The absolute pressure may be between 30 mbar and 10 bar, such as between 1 bar and 10 bar. In some implementations, in such an embodiment, the induction coil assembly may be operated at a voltage of 1000 V or more, such as 1200 V or more, such as 1500 V or more. The induction coil assembly may comprise at least one induction coil having four serial windings or less, such as three serial windings or less, such as two serial windings or less (i.e. having only one winding).

An induction coil having four windings may also be referred to as a four-windings induction coil. Here, it describes an induction coil with four serially interconnected windings. An induction coil with three windings can also be called a three-windings induction coil. It describes here an induction coil with three serially interconnected windings. An induction coil with two windings can also be called a two-windings induction coil. It describes here an induction coil with two serially linked windings. An induction coil with one winding may also be referred to as a single-winding induction coil.

The induction coil assembly may comprise at least one induction coil having at least two parallel windings with a common current draw. In some implementations, the induction coil assembly may comprise an induction coil having exactly two parallel windings with a common current draw. In this case, the induction coil assembly comprises a single winding induction coil having two parallel windings.

Accordingly, the above-described embodiments of the induction coil may be combined. For example, the induction coil assembly may comprise an n×m-windings induction coil, where m indicates the number of serial windings of the induction coil and n indicates the number of parallel m-winding winding arrangements. In one embodiment, the induction coil assembly may comprise a 2×2-windings induction coil, i.e., an induction coil with a total of four windings, of which two serially interconnected windings are connected in parallel with two other serially interconnected windings and have a common current draw therewith. In some implementations, in such an arrangement, the first and the last, i.e. the uppermost and the lowermost or outer, windings are serially interconnected and the second and the third, i.e. the two intermediate or inner, windings are serially interconnected. The two outer windings are interconnected in parallel with the two inner windings. In one embodiment, the induction coil assembly may comprise a 2×1-windings induction coil, i.e., an induction coil having two parallel windings in total. In one embodiment, the induction coil assembly may comprise a 1×2-windings induction coil, in other words a two-winding induction coil, i.e. an induction coil with a total of two serial windings.

An induction coil assembly of the type described above can contribute to achieve the desired optimal balance between ensuring a sufficient superheating of the melt jet, achieving a reasonable mold filling time and an energy consumption acceptable in practice. Thus, an induction coil assembly of the type described above, such as a 2×2-windings induction coil, can contribute to ensure a uniform power input into the electrode tip of an electrode with a large electrode diameter (e.g. 150 mm or more), while at the same time avoiding that the voltage of an upper limit of, for instance, 1000 V is exceeded.

The use of an induction coil with a smaller number of windings—compared to a coil of the same dimension and a larger number of windings—enables to generate a larger superheating when operated at a lower voltage. Here, in some implementations, a two-windings (1×2-windings) induction coil or a 2×2-windings induction coil may be provided, for example.

The induction coil assembly may comprise a first induction coil and at least one second induction coil. The two induction coils are separate from each other and each has its own current draw. The first induction coil, the at least second induction coil, or the first and the at least second induction coils may be formed with the features described above. The first induction coil may be supplied or operated with a power P1, a frequency f1 and a voltage U1 (such as U1≤1000 V). The at least second induction coil can be supplied or operated with a power P2, a frequency f2 and a voltage U2 (such as U2≤1000 V).

In one embodiment, the first induction coil and the at least second induction coil can be arranged in such a way that both induction coils serve to melt off the electrode. For this purpose, the two induction coils may be arranged side by side and aligned along an imaginary cylinder or an imaginary cone. In other words, in a cross-sectional view, adjacent winding cross-sections of both induction coils may be aligned along a common axis. The common axis may be arranged substantially parallel to an inclined surface of a melted off end portion of the electrode. Both induction coils may have a conical shape.

The two induction coils may be embedded in a soft magnetic yoke, thereby preventing an unwanted coil interaction. By means of such an embodiment, the generated melt flow rate can be increased, i.e., P1+P2 leads to an increase in the melt flow rate MFR.

In one embodiment, the first induction coil may be arranged to serve to melt off the electrode, while the at least second induction coil may be arranged downstream of the first induction coil and can be arranged to serve to heat the melt jet. For this purpose, the winding(s) of the first induction coil can be arranged substantially parallel to an inclined surface of a melted off end portion of the electrode. The first induction coil may have a conical shape. The downstream at least second induction coil may be coaxial with the melt jet generated by the first induction coil and may have a cylindrical shape. The at least second induction coil may be embedded in a soft magnetic yoke. By means of such an embodiment, the superheating of the generated melt jet can be further increased, i.e. P2 serves to enhance the superheating.

In one embodiment, the first induction coil may be arranged to serve for melting off the electrode, while the second induction coil may be located upstream of the first induction coil and arranged to serve for preheating the electrode to be melted off. For this purpose, the winding(s) of the first induction coil may be arranged substantially parallel to an inclined surface of a melted off end portion of the electrode. The first induction coil may have a conical shape. The upstream at least second induction coil may be coaxial with the electrode and may have a cylindrical shape. The at least second induction coil may be embedded in a soft magnetic yoke. By means of such an embodiment, the superheating of the generated melt jet can be further increased, i.e. P2 serves to enhance the superheating. In addition, the upstream second induction coil may also contribute at least slightly to the generation of the melt jet, so that P1+P2 contribute to an increase in the melt flow rate MFR.

In one embodiment, the induction coil assembly may have an average coil diameter of 50 mm or more, such as 150 mm or more. In some implementations, the induction coil assembly may configured to be able to receive at least partially an electrode having a diameter of 50 mm or more, such as of 150 mm or more. The use of an electrode with a diameter of 150 mm or more may contribute to provide sufficient material for filling an investment casting mold, since the length of the electrodes may be limited due to the system.

Another aspect of the disclosure relates to a system for producing an investment casting component, comprising a device of the type described above and the electrode at least partially received therein.

The electrode may be a cast electrode. Alternatively, the electrode may be a compacted electrode comprising a plurality of particles or sections. The particles or sections can be of undefined shape, i.e. they can have different and almost arbitrary shapes. Such an electrode may be less expensive to manufacture. The electrode may consist of or comprise a metal alloy. The electrode may comprise or consist of titanium or a titanium alloy, for example Ti64. The electrode may comprise or consist of a nickel-chromium alloy, for example IN718. It is to be understood that the electrode may also comprise or consist of other metals or metal alloys.

Another aspect of the disclosure relates to a method for producing an investment casting component, that is, an investment casting method. The method comprises the steps of:

- providing an electrode in a melting chamber;
- inserting the electrode, at least in sections, into an induction coil assembly disposed in the melting chamber;
- generating a ceramic-free, continuous melt jet with a melt flow rate of at least 2.5 kg/min by melting off the electrode by means of the induction coil assembly;
- providing an investment casting mold in a casting chamber downstream of and connected to the melting chamber;
- continuously filling the investment casting mold with the melt jet.

The investment casting mold may be heated during the production process by means of a mold heater of the casting chamber.

The investment casting mold may be extracted during continuous filling in a direction away from the melting chamber by means of a mold extractor.

In the method, the induction coil assembly can be operated at a power P for which the following conditions are satisfied:

$$P\ [\mathrm{kW}] \geq 5\left[\mathrm{kW}\cdot\frac{\mathrm{min}}{\mathrm{kg}}\right]\cdot MFR,$$

$$\text{such as } P\ [\mathrm{kW}] \geq 15\left[\mathrm{kW}\cdot\frac{\mathrm{min}}{\mathrm{kg}}\right]\cdot MFR,$$

$$\text{such as } P\ [\mathrm{kW}] \geq 50\left[\mathrm{kW}\cdot\frac{\mathrm{min}}{\mathrm{kg}}\right]\cdot MFR,$$

-continued $$\text{such as } P\ [\mathrm{kW}] \geq 125\left[\mathrm{kW}\cdot\frac{\mathrm{min}}{\mathrm{kg}}\right]\cdot MFR.$$

In the method, the induction coil assembly can be operated at a power P for which the following conditions are satisfied:

$$P\ [\mathrm{kW}] \leq 600\left[\mathrm{kW}\cdot\frac{\mathrm{min}}{\mathrm{kg}}\right]\cdot MFR,$$

$$\text{such as } P\ [\mathrm{kW}] \leq 300\left[\mathrm{kW}\cdot\frac{\mathrm{min}}{\mathrm{kg}}\right]\cdot MFR,$$

$$\text{such as } P\ [\mathrm{kW}] \leq 100\left[\mathrm{kW}\cdot\frac{\mathrm{min}}{\mathrm{kg}}\right]\cdot MFR,$$

$$\text{such as } P\ [\mathrm{kW}] \leq 35\left[\mathrm{kW}\cdot\frac{\mathrm{min}}{\mathrm{kg}}\right]\cdot MFR.$$

In the method, the induction coil assembly can be operated at a power P for which the following conditions are satisfied:

$$5\left[\mathrm{kW}\cdot\frac{\mathrm{min}}{\mathrm{kg}}\right]\cdot MFR \leq P\ [\mathrm{kW}] \leq 600\left[\mathrm{kW}\cdot\frac{\mathrm{min}}{\mathrm{kg}}\right]\cdot MFR,$$

$$\text{such as } 15\left[\mathrm{kW}\cdot\frac{\mathrm{min}}{\mathrm{kg}}\right]\cdot MFR \leq P\ [\mathrm{kW}] \leq 125\left[\mathrm{kW}\cdot\frac{\mathrm{min}}{\mathrm{kg}}\right]\cdot MFR,$$

$$\text{such as } 17,5\left[\mathrm{kW}\cdot\frac{\mathrm{min}}{\mathrm{kg}}\right]\cdot MFR \leq P\ [\mathrm{kW}] \leq 90\left[\mathrm{kW}\cdot\frac{\mathrm{min}}{\mathrm{kg}}\right]\cdot MFR,$$

$$\text{such as } 20\left[\mathrm{kW}\cdot\frac{\mathrm{min}}{\mathrm{kg}}\right]\cdot MFR \leq P\ [\mathrm{kW}] \leq 30\left[\mathrm{kW}\cdot\frac{\mathrm{min}}{\mathrm{kg}}\right]\cdot MFR.$$

The power P can be set as a function of a diameter of the electrode to be melted off in accordance with the above conditions.

In the method, the induction coil assembly, such as when using an electrode with a diameter of 150 mm, can be operated with a power P for which the following conditions are satisfied:

$$P\ [\mathrm{kW}] \geq 15\left[\mathrm{kW}\cdot\frac{\mathrm{min}}{\mathrm{kg}}\right]\cdot MFR,$$

$$\text{such as } P\ [\mathrm{kW}] \geq 17,5\left[\mathrm{kW}\cdot\frac{\mathrm{min}}{\mathrm{kg}}\right]\cdot MFR,$$

$$\text{such as } P\ [\mathrm{kW}] \geq 20\left[\mathrm{kW}\cdot\frac{\mathrm{min}}{\mathrm{kg}}\right]\cdot MFR,$$

$$\text{such as } P\ [\mathrm{kW}] \geq 22,5\left[\mathrm{kW}\cdot\frac{\mathrm{min}}{\mathrm{kg}}\right]\cdot MFR.$$

In the method, the induction coil assembly can be used to superheat the melt jet as a function of the melt flow rate MFR in such a way that the superheating temperature $T_{sup}$ satisfies the following conditions:

$$T_{sup}\ [^\circ\ \mathrm{C.}] \geq 5\left[^\circ\ \mathrm{C.}\cdot\frac{\mathrm{min}}{\mathrm{kg}}\right]\cdot MFR,$$

$$\text{such as } T_{sup}\ [^\circ\ \mathrm{C.}] \geq 45\left[^\circ\ \mathrm{C.}\cdot\frac{\mathrm{min}}{\mathrm{kg}}\right]\cdot MFR,$$

-continued $$\text{such as } T_{sup}\ [^\circ\text{ C.}] \geq 100\left[^\circ\text{ C.}\cdot\frac{\text{min}}{\text{kg}}\right]\cdot MFR,$$

$$\text{such as } T_{sup}\ [^\circ\text{ C.}] \geq 270\left[^\circ\text{ C.}\cdot\frac{\text{min}}{\text{kg}}\right]\cdot MFR.$$

In the method, the induction coil assembly can be used to superheat the melt jet as a function of the melt flow rate MFR in such a way that the superheating temperature $T_{sup}$ satisfies the following conditions:

$$T_{sup}\ [^\circ\text{ C.}] \leq 600\left[^\circ\text{ C.}\cdot\frac{\text{min}}{\text{kg}}\right]\cdot MFR,$$

$$\text{such as } T_{sup}\ [^\circ\text{ C.}] \leq 400\left[^\circ\text{ C.}\cdot\frac{\text{min}}{\text{kg}}\right]\cdot MFR,$$

$$\text{such as } T_{sup}\ [^\circ\text{ C.}] \leq 250\left[^\circ\text{ C.}\cdot\frac{\text{min}}{\text{kg}}\right]\cdot MFR,$$

$$\text{such as } T_{sup}\ [^\circ\text{ C.}] \leq 100\left[^\circ\text{ C.}\cdot\frac{\text{min}}{\text{kg}}\right]\cdot MFR.$$

In the method, the induction coil assembly can be used to superheat the melt jet as a function of the melt flow rate MFR in such a way that the superheating temperature $T_{sup}$ satisfies the following conditions:

$$5\left[^\circ\text{ C.}\cdot\frac{\text{min}}{\text{kg}}\right]\cdot MFR \leq T_{sup}\ [^\circ\text{ C.}] \leq 600\left[^\circ\text{ C.}\cdot\frac{\text{min}}{\text{kg}}\right]\cdot MFR,$$

$$\text{such as } 7\left[^\circ\text{ C.}\cdot\frac{\text{min}}{\text{kg}}\right]\cdot MFR \leq T_{sup}\ [^\circ\text{ C.}] \leq 400\left[^\circ\text{ C.}\cdot\frac{\text{min}}{\text{kg}}\right]\cdot MFR,$$

$$\text{such as } 25\left[^\circ\text{ C.}\cdot\frac{\text{min}}{\text{kg}}\right]\cdot MFR \leq T_{sup}\ [^\circ\text{ C.}] \leq 250\left[^\circ\text{ C.}\cdot\frac{\text{min}}{\text{kg}}\right]\cdot MFR,$$

$$\text{such as } 10\left[^\circ\text{ C.}\cdot\frac{\text{min}}{\text{kg}}\right]\cdot MFR \leq T_{sup}\ [^\circ\text{ C.}] \leq 100\left[^\circ\text{ C.}\cdot\frac{\text{min}}{\text{kg}}\right]\cdot MFR.$$

The superheating temperature $T_{sup}$ can be set in dependence on a diameter of the electrode to be melted off according to the above conditions.

In the method, the induction coil assembly can be used to superheat the melt jet as a function of the melt flow rate MFR, such as for melting off an electrode with a diameter of 150 mm, in such a way that the superheating temperature $T_{sup}$ satisfies the following conditions:

$$T_{sup}\ [^\circ\text{ C.}] \geq 5\left[^\circ\text{ C.}\cdot\frac{\text{min}}{\text{kg}}\right]\cdot MFR,$$

$$\text{such as } T_{sup}\ [^\circ\text{ C.}] \geq 6,5\left[^\circ\text{ C.}\cdot\frac{\text{min}}{\text{kg}}\right]\cdot MFR,$$

$$\text{such as } T_{sup}\ [^\circ\text{ C.}] \geq 7,9\left[^\circ\text{ C.}\cdot\frac{\text{min}}{\text{kg}}\right]\cdot MFR.$$

The melt jet can be superheated by the induction coil assembly by at least 10° C., such as by at least 20° C., such as by at least 40° C., such as by at least 60° C., such as by at least 80° C.

The induction coil assembly may be operated at a voltage of 1200 V or less, such as 1000 V or less. The induction coil assembly can be operated at a frequency between 10 kHz and 300 kHz, such as between 50 kHz and 200 kHz, such as between 75 kHz and 125 kHz.

At least the melting chamber can be pressurized with an absolute pressure, so that the melt jet is generated under this absolute pressure. The absolute pressure can be at least 30 mbar, such as at least 1 bar, such as at least 5 bar. The absolute pressure may be less than 10 bar. The absolute pressure may be between 30 mbar and 10 bar, such as between 1 bar and 10 bar.

A further aspect relates to the structural design of the induction coil assembly. This aspect may be independent of the described embodiment of the overall device and may form a separate subject matter. The induction coil assembly may comprise at least one induction coil comprising four serial windings or less, such as comprising three serial windings or less, such as comprising two serial windings or less (i.e. having only one winding). An induction coil comprising four windings may also be referred to as a four-windings induction coil. Here, it describes an induction coil with four serially interconnected windings. An induction coil with three windings can also be denoted as a three-windings induction coil. Here, it describes an induction coil with three serially interconnected windings. An induction coil with two windings can also be denoted as a two-windings induction coil. Here, it describes an induction coil with two serially interconnected windings. An induction coil with one winding may also be referred to as a single-winding induction coil.

The induction coil assembly may comprise at least one induction coil comprising at least two parallel windings with a common current draw. In some implementations, the induction coil assembly may comprise an induction coil comprising exactly two parallel windings with a common current draw. In this case, the induction coil assembly comprises a single-winding induction coil comprising two parallel windings.

Accordingly, the above-described embodiments of the induction coil assembly may be combined. Thus, the induction coil assembly may comprise an n×m-windings induction coil, where m indicates the number of serial windings of the induction coil and n indicates the number of parallel m-windings winding arrangements. In one embodiment, the induction coil assembly may comprise a 2×2-windings induction coil, i.e., an induction coil with a total of four windings, of which two serially interconnected windings are connected in parallel with two other serially interconnected windings and have a common current draw therewith. In some implementations, in such an arrangement, the first and the last, i.e. the uppermost and the lowermost or outer, windings are serially interconnected and the second and the third, i.e. the two intermediate or inner, windings are serially interconnected. The two outer windings are interconnected in parallel with the two inner windings. In one embodiment, the induction coil assembly may comprise a 2×1-windings induction coil, i.e., an induction coil comprising two parallel windings in total. In one embodiment, the induction coil assembly may comprise a 1×2-windings induction coil, in other words a two-windings induction coil, i.e. an induction coil with a total of two serial windings.

The use of an induction coil with a smaller number of windings—compared to a coil of the same dimension and a larger number of windings—enables to generate greater superheating when operated at a lower voltage. In some implementations, a two-windings (1×2-windings) induction coil or a 2×2-windings induction coil may be provided here, for example.

Although some features, advantages, functions, modes of operation, embodiments and further developments have been described above only with respect to the device, they may correspondingly also apply to the method and vice versa.

BRIEF DESCRIPTION OF THE FIGURES

Exemplary embodiments of the present disclosure are explained in more detail below with reference to the accompanying schematic drawing. In the drawing.

DESCRIPTION OF THE FIGURES

Figure 1:
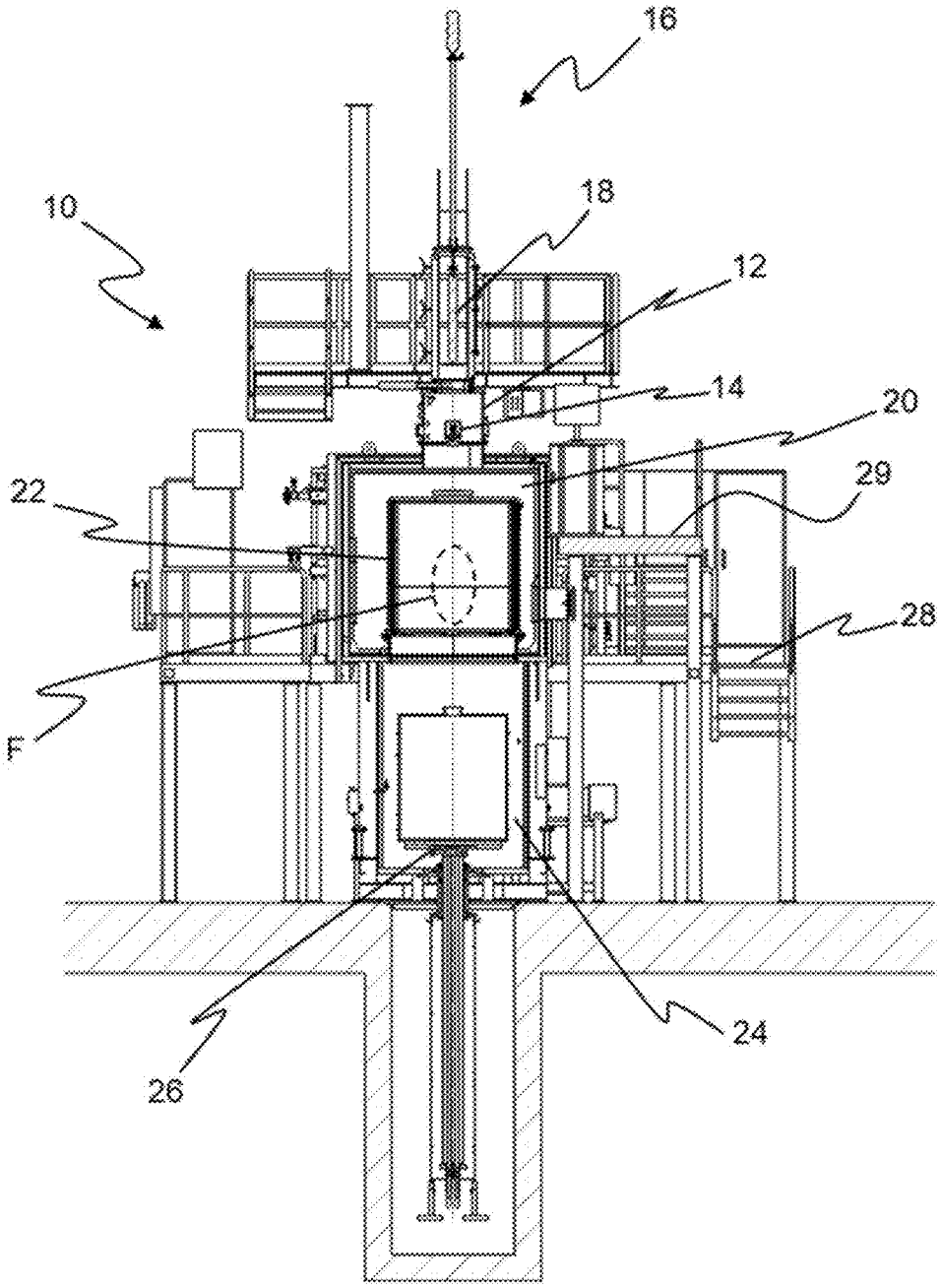
FIG. 1 is a schematic sectional view of a device according to one embodiment of the disclosure.

FIG. 1 shows a device or plant 10 for producing investment casting components. The device 10 comprises a melting chamber 12 comprising an induction coil assembly 14 mounted in the melting chamber 12. A vacuum is applied to the melting chamber 12. Alternatively, the melting chamber 12 may be pressurized with an inert gas atmosphere.

Above the melting chamber 12, i.e. upstream thereof, an electrode charger 16 is disposed. This comprises an electrode 18 that can be displaced along its longitudinal axis in the direction of the induction coil assembly 14 and can be rotated about its longitudinal axis by means of the electrode charger 16. In this embodiment, the electrode 18 is an electrode made of a titanium alloy. It is understood that electrodes of other metals or metal alloys may likewise be provided. The electrode 18 is inserted into the induction coil assembly 14 at least in sections, more specifically with a lower end portion, during operation of the plant.

Figure 2A:
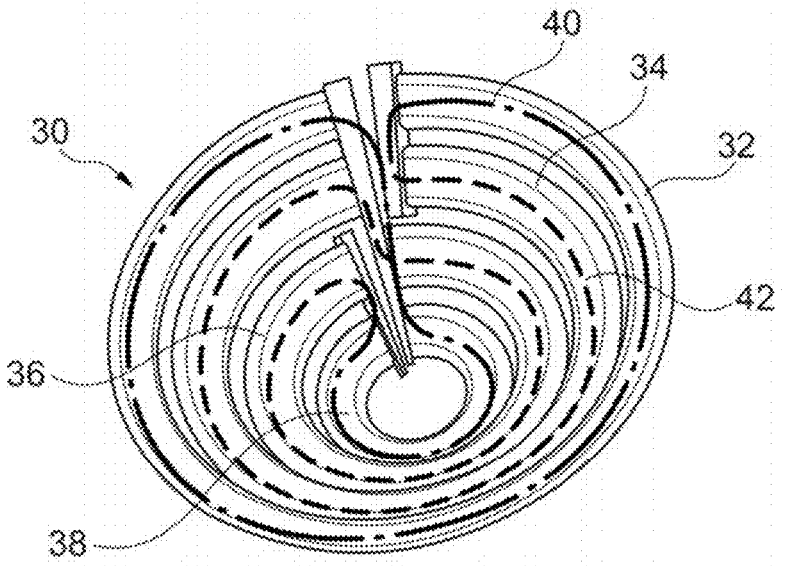
FIG. 2A is a schematic representation of an embodiment of an induction coil according to the disclosure for the device of FIG. 1.
Figure 2B:
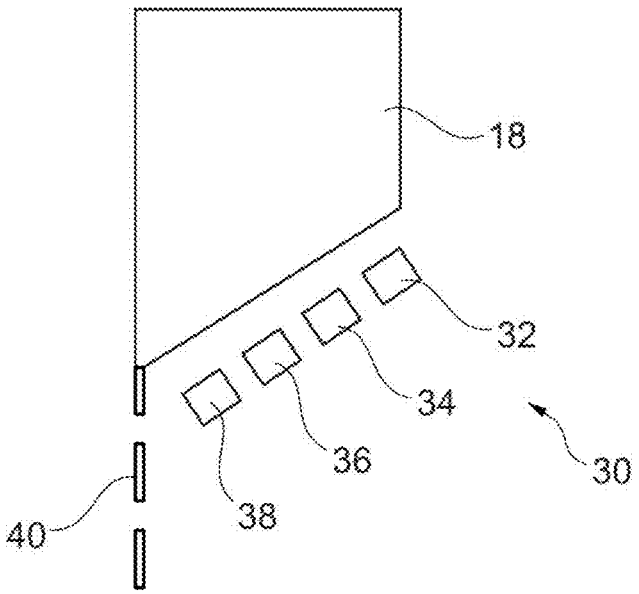
FIG. 2B is a schematic sectional view of the induction coil of FIG. 2A in operation.

The induction coil assembly 14 is adapted to melt the electrode 18 off in order to produce a ceramic-free continuous melt jet (not shown in FIG. 1, but see, for example, FIG. 2B). Feeding the electrode 18, as well as rotating the electrode 18 by means of the electrode charger 16, can ensure uniform melting of the electrode 18 and a generation of a substantially uninterrupted, continuous melt jet.

The induction coil assembly 14 is operated or controlled to melt off the electrode 18 and to generate a continuous melt jet with a melt flow rate MFR of at least 2.5 kg/min, such as between 2.5 kg/min and 10 kg/min.

The device 10 further comprises a casting chamber 20 which is disposed downstream of the melting chamber 12, i.e. arranged below the latter, and is connected to the melting chamber 12 in a pressure-tight manner. The casting chamber 20 is adapted to receive an investment casting mold (not shown here) that is filled with the melt jet during operation. The investment casting mold may have any shape, depending on the investment casting to be produced. In some implementations, the investment casting mold may be a ceramic mold.

The casting chamber 20 includes a mold heater 22. The mold heater 22 is used to heat an investment casting mold provided in the casting chamber 20 prior to the start of the melting process or a melting sequence. In addition, the mold heater 22 can be used to further heat the investment casting mold during melting and filling. This can prevent the melt from solidifying too early and upon contact with the wall of the investment casting mold, which would negatively affect the quality of the investment casting component.

Below the casting chamber 20, an loading/unloading chamber 24 of the device 10 is formed, which is connected to the casting chamber 20. The loading/unloading chamber 24 is used for inserting the investment casting mold and removing the cast investment casting component.

A mold extractor 26 is formed in the loading/unloading chamber 24, by means of which the investment casting mold can be extracted in a direction away from the melting chamber 12.

FIG. 1 also shows a maintenance platform 28 formed at the device 10 and an operating platform 29 formed at the apparatus 10.

FIGS. 2A and 2B show an embodiment of an induction coil 30 of the induction coil assembly 14 of FIG. 1. As can be seen in the perspective view of FIG. 2A, the induction coil 30 in this embodiment is formed as a 2×2-windings induction coil. That is, the induction coil 30 comprises two parallel two-windings winding arrangements. The windings 32 to 38 have a common current draw (not shown). The current flow through the induction coil 30, or more precisely its equal division due to the parallel connection, is shown in FIG. 2A by lines 40 and 42. Moreover, the uniform distribution of the current is indicated in FIG. 2B by the different patterns of the cross-sections of the windings 32 to 38. As can be seen from FIGS. 2A and 2B, windings 32 and 38 are connected in series and in parallel with windings 34 and 36, which (i.e. windings 34 and 36) in turn are connected in series.

By use of the 2×2-windings coil configuration shown in FIGS. 2A and 2B, a uniform power input to the electrode 18 to be melted off can be achieved. It is understood that in other embodiments of the disclosure other coil configurations may be provided. In some implementations, two-windings, three-windings or four-windings coil configurations without parallel windings may be provided. Alternatively, single-winding coil configurations with or without parallel connection of windings may be provided (an induction coil with two or more parallel single-winding winding arrangements may nevertheless be referred to herein as a single-winding coil).

In addition to the coil configuration, FIG. 2B also shows the electrode 18 inserted into the induction coil 30 in sections and melted off at a lower end by means of the induction coil 30, thereby producing a continuous melt jet 40.

Figure 5:
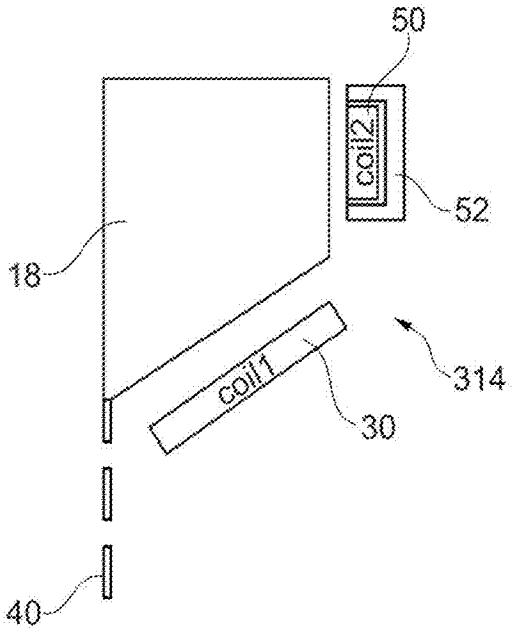
FIG. 5 is a schematic representation of a third embodiment of an induction coil assembly according to the disclosure in operation.
Figure 4:
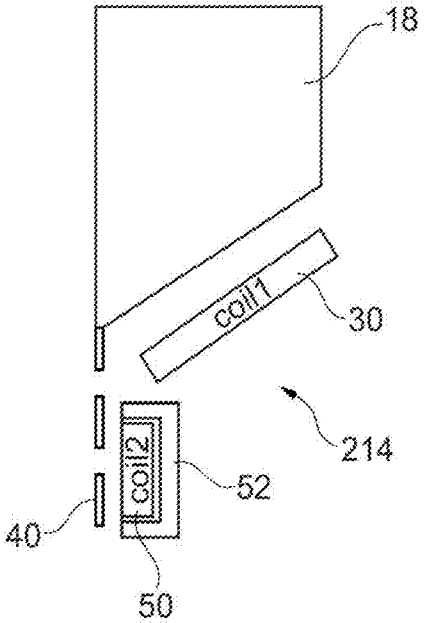
FIG. 4 is a schematic representation of a second embodiment of an induction coil assembly according to the disclosure in operation.
Figure 3:
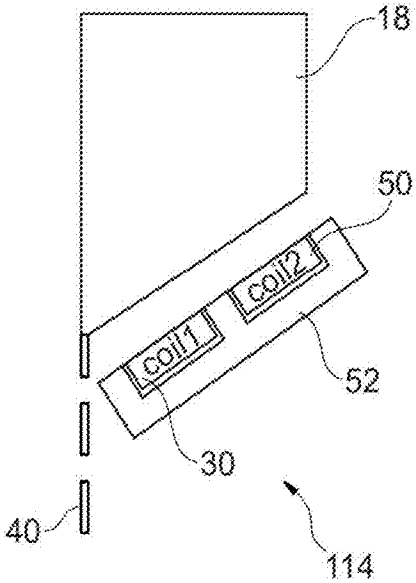
FIG. 3 is a schematic representation of a first embodiment of an induction coil assembly according to the disclosure in operation.

Different induction coil assemblies 114, 214 and 314 are shown in FIGS. 3 to 5. Each of these induction coil assemblies 114, 214, 314 comprises in the embodiments shown, in addition to the induction coil 30, a further induction coil 50, which are only schematically indicated in FIGS. 3 to 5. They can each be a single- or multi-windings configuration and have the same or a different number of windings. The two induction coils 30, 50 are formed and controlled separately from each other in the induction coil assemblies 114, 214, 314 shown. They each have their own power supply. In the embodiments shown, the induction coil 30 is operated at a power P1, a frequency f1, and a voltage U1 (here, for example, U1≤1000 V, P1≤500 kW, f1≤350 kHz). The second induction coil 50 is operated at a power P2, a frequency f2 and a voltage U2 (here, for example, U2≤1000 V, P2≤500 kW, f2≤350 kHz).

In the embodiment shown in FIG. 3, both induction coils 30, 50 are arranged such that they both serve to melt off the electrode 18. The induction coils 30, 50 are arranged side by side. In the cross-sectional view shown, the adjacent winding cross-sections of both induction coils are arranged substantially parallel to an inclined surface of the melted off end portion of the electrode 18. Both induction coils 30, 50 have a conical shape in FIG. 3. The two induction coils 30, 50 are here embedded in a soft magnetic yoke 52, whereby an undesired coil interaction is prevented. By means of such an embodiment, the generated melt flow rate MFR can be increased by increasing the powers P1 and P2 of the two induction coils 30, 50.

In the embodiment shown in FIG. 4, the first induction coil 30 is arranged such that it serves to melt off the electrode 18. The second induction coil 50 is arranged downstream of the first induction coil and is arranged such that it serves to heat the already melted melt jet 40. The winding/s of the first induction coil 30 are arranged substantially parallel to the inclined surface of the melted off end portion of the electrode 18. The first induction coil 30 has a conical shape. The downstream second induction coil 50 has a cylindrical shape and encloses the melt jet 40 in sections. The second induction coil 50 is embedded in a soft magnetic yoke 52. By means of such an embodiment, the superheating of the generated melt jet can be further increased by increasing the power P2 of the second induction coil 50.

In the embodiment shown in FIG. 5, the first induction coil 30 is arranged such that it serves to melt off the electrode 18. The second induction coil 50 is located upstream of the first induction coil 30 and is arranged such that it serves to preheat the electrode 18 to be melted. For this purpose, the windings of the first induction coil 30 are arranged substantially parallel to the inclined surface of the melted end portion of the electrode 18. Here, too, the first induction coil 30 has a conical shape. The upstream second induction coil 50 has a cylindrical shape and encloses the electrode 18 in sections, more precisely a part of the electrode 18 which has not yet been melted off. The second induction coil 50 is embedded in a soft magnetic yoke 52. By means of such an embodiment, the superheating of the generated melt jet can be further increased by increasing the power P2 of the second induction coil 50. In addition, the upstream second induction coil 50 may also contribute at least slightly to the generation of the melt jet, so that an increase in P1 and P2 may contribute to an increase in the melt flow rate MFR.

Figure 6:
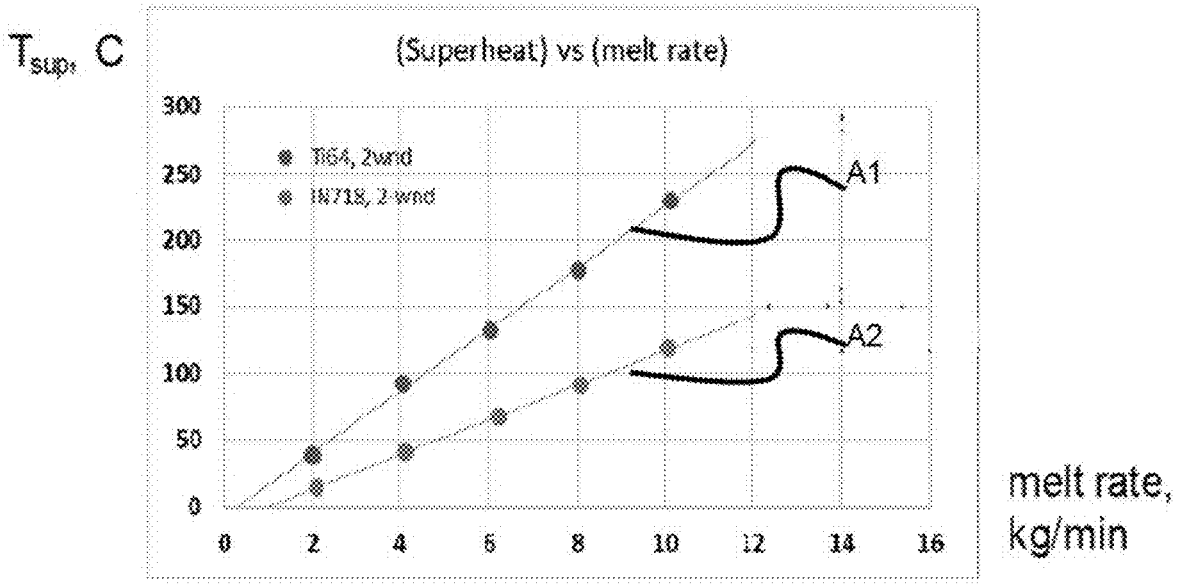
FIG. 6 is a diagram showing the relationship between superheating temperature and melt flow rate in a device according to the disclosure for different electrode materials.

FIG. 6 shows a diagram illustrating a determined relationship between the superheating temperature $T_{sup}$ [° C.] of the melt jet and the melt flow rate MFR [kg/min] in a device 10 according to the disclosure comprising a two-windings induction coil. Line A1 shows the relationship for an electrode 18 made of Ti64. Line A2 shows the relationship for an electrode 18 made of IN718. As can be seen, sufficient superheating can be achieved at a melt flow rate of at least 2.5 kg/min.

Figure 7:
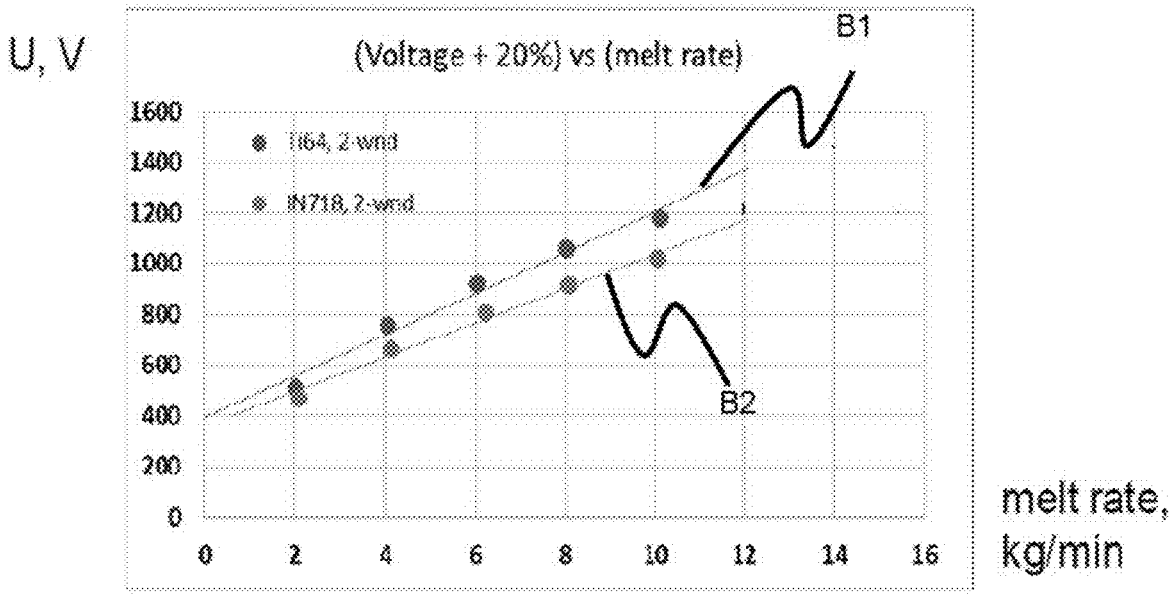
FIG. 7 is a diagram showing the relationship between voltage and melt flow rate in a device according to the disclosure for different electrode materials.

FIG. 7 shows a diagram illustrating a determined relationship between the voltage U [V] at which the induction coil is operated and the melt flow rate MFR [kg/min] in a device 10 according to the disclosure comprising a two-windings induction coil. Line B1 shows the relationship for an electrode 18 made of Ti64. Line B2 shows the relationship for an electrode 18 made of IN718.

Figure 8:
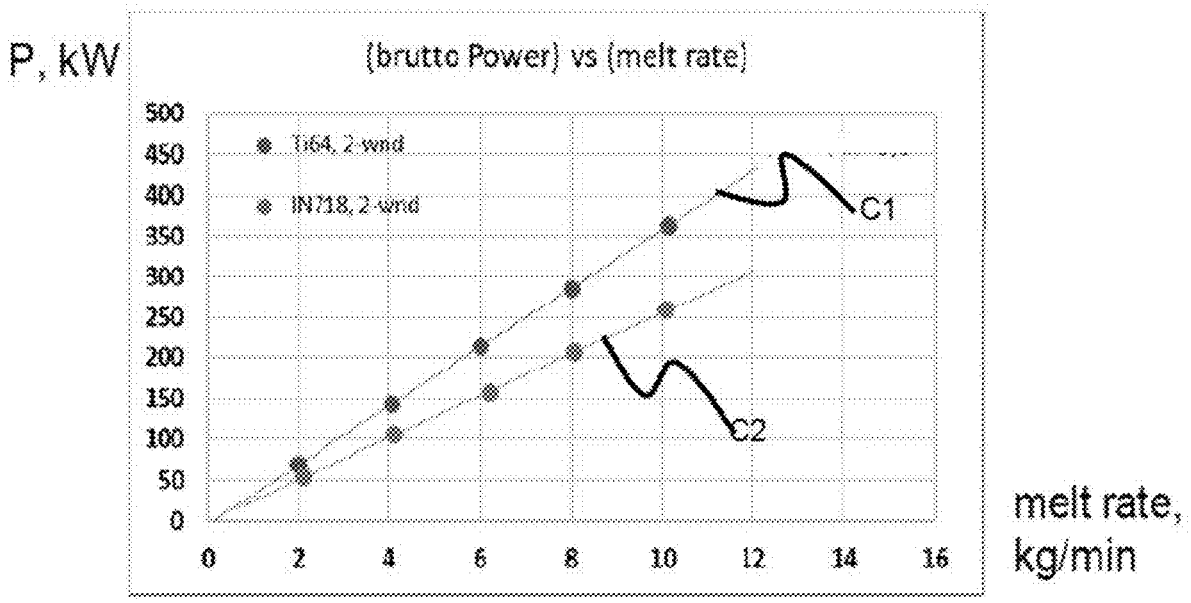
FIG. 8 is a diagram showing the relationship between power and melt flow rate in a device according to the disclosure for different electrode materials.

FIG. 8 shows a diagram illustrating a determined relationship between the power P [kW] at which the induction coil is operated and the melt flow rate MFR [kg/min] in a device 10 according to the disclosure comprising a two-windings induction coil. Line C1 shows the relationship for an electrode 18 made of Ti64. Line C2 shows the relationship for an electrode 18 made of IN718.

Figure 9:
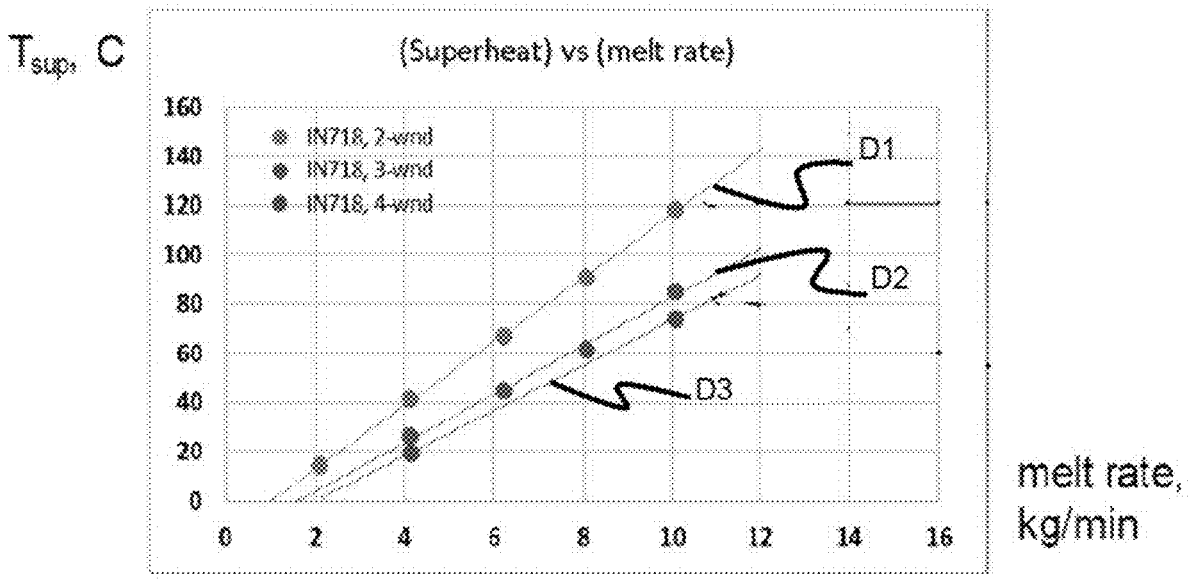
FIG. 9 is a diagram showing the relationship between superheating temperature and melt flow rate in devices according to the disclosure with different induction coil designs.

FIG. 9 shows a diagram illustrating a determined relationship between the superheating temperature $T_{sup}$ [° C.] of the melt jet and the melt flow rate MFR [kg/min] in devices 10 according to the disclosure comprising different induction coil designs. More specifically, the relationship is shown here for induction coil designs with different numbers of windings. Line D1 shows the relationship for a two-windings induction coil for generating the melt jet (without windings connected in parallel). Line D2 shows the relationship for a three-windings induction coil for generating the melt jet (without windings connected in parallel). Line D3 shows the relationship for a four-windings induction coil for generating the melt jet (without windings connected in parallel). As can be seen, a larger superheating temperature $T_{sup}$ can be achieved with the same melt flow rate MFR by using a smaller number of windings in the induction coil.

Figure 10:
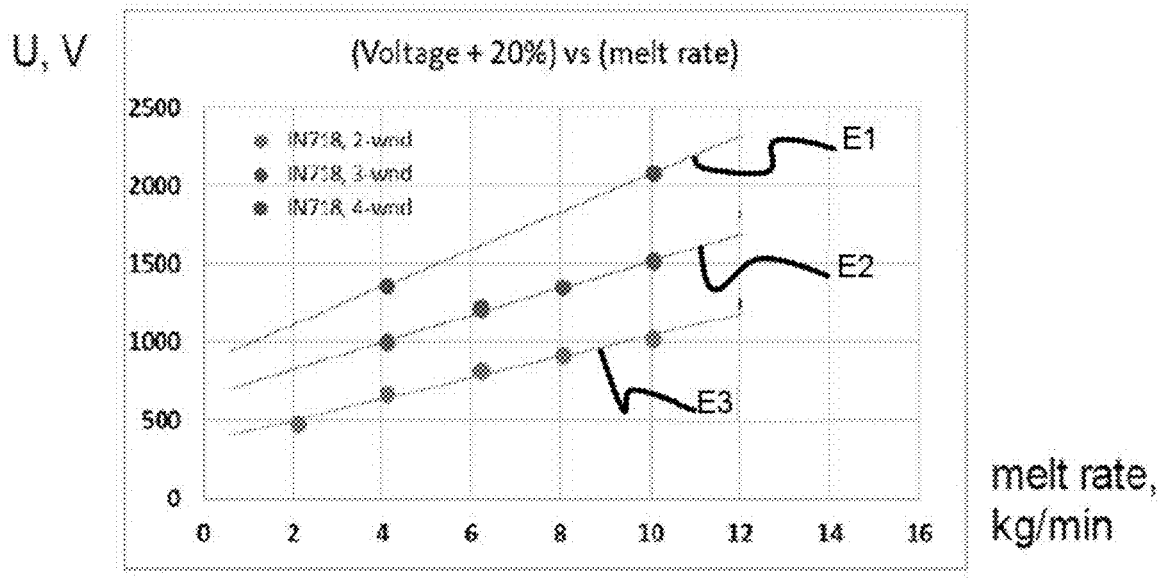
FIG. 10 is a diagram showing the relationship between voltage and melt flow rate in devices according to the disclosure with different induction coil designs.

FIG. 10 shows a diagram illustrating a determined relationship between the voltage U [V] with which the induction coil is operated and the melt flow rate MFR [kg/min] in devices 10 according to the disclosure with different induction coil designs. More precisely, the relationship is shown here for induction coil designs with different numbers of windings. Line E1 shows the relationship for a two-windings induction coil for generating the melt jet (without windings connected in parallel). Line E2 shows the relationship for a three-windings induction coil for generating the melt jet (without windings connected in parallel). Line E3 shows the relationship for a four-windings induction coil for generating the melt jet (without windings connected in parallel). As can be seen, with a lower number of windings in the induction coil, a lower voltage U is required for generating the same melt flow rate MFR.

Figure 11:
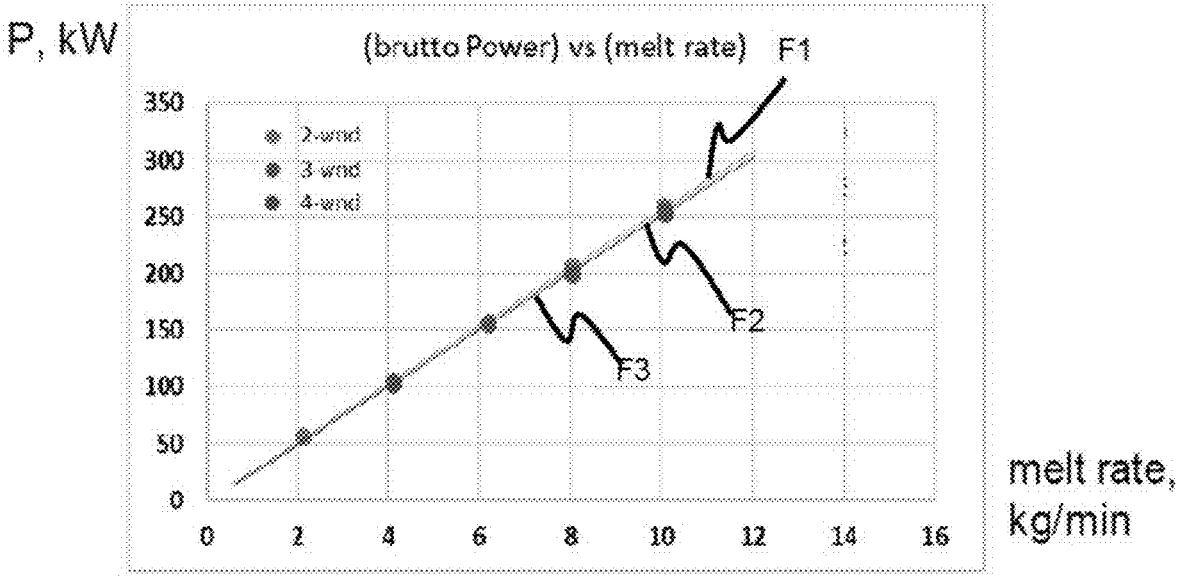
FIG. 11 is a diagram showing the relationship between power and melt flow rate in devices according to the disclosure with different induction coil designs.

FIG. 11 shows a diagram illustrating a determined relationship between the power P [kW] with which the induction coil is operated and the melt flow rate MFR [kg/min] in devices 10 according to the disclosure with different induction coil designs. More precisely, the relationship is shown here for induction coil designs with different numbers of windings. Line F1 shows the relationship for a two-windings induction coil for generating the melt jet (without windings connected in parallel). Line F2 shows the relationship for a three-windings induction coil for generating the melt jet (without windings connected in parallel). Line F3 shows the relationship for a four-winding induction coil for generating the melting beam (without windings connected in parallel). As can be seen, the different number of windings of the induction coil has no significant effect on the power P required to be applied to generate a given melt flow rate MFR.

The diagrams in FIGS. 9 to 11 refer to an electrode used made of IN718 with an electrode diameter of 150 mm.

The frequency of the induction coil set for FIGS. 6 to 11 is 100 kHz.

LIST OF REFERENCE SYMBOLS

10 device
12 melting chamber
14, 114, 214, 314 induction coil assemblies
16 electrode charger
18 electrode
20 casting chamber
22 mold heater
24 loading/unloading chamber
26 mold extractor
28 maintenance platform
29 operating platform
30 induction coil
32, 34, 36, 38 windings
40, 42 melt jet
50 second induction coil
52 soft magnetic yoke

The invention claimed is:

1. A device for producing an investment casting component, comprising:

a melting chamber comprising an induction coil assembly disposed in the melting chamber and adapted to melt off an electrode at least partially received therein to produce a ceramic-free continuous melt jet with a melt flow rate (MFR) of at least 2.5 kg/min;

an electrode charger disposed upstream of the melting chamber and adapted to displace the electrode along its longitudinal axis in the direction of the induction coil assembly; and a casting chamber downstream of the melting chamber and connected thereto and comprising an investment casting mold received or receivable therein for being filled by means of the ceramics-free continuous melt jet.

2. The device according to claim 1, wherein the casting chamber comprises a mold heater adapted to heat the investment casting mold.

3. The device according to claim 1, wherein the induction coil assembly is operated with a power P for which the following condition is satisfied:

$$P[\mathrm{kW}] \geq 5\left[\mathrm{kW}\cdot\frac{\mathrm{min}}{\mathrm{kg}}\right]\cdot MFR.$$

4. The device according to claim 1, wherein the induction coil assembly is arranged to superheat the melt jet in dependence on the melt flow rate (MFR) such that the superheat temperature ($T_{sup}$) satisfies the following condition:

$$T_{sup}[^\circ\ \mathrm{C.}] \geq 5\left[^\circ\ \mathrm{C.}\cdot\frac{\mathrm{min}}{\mathrm{kg}}\right]\cdot MFR.$$

5. The device according to claim 1, wherein the induction coil assembly is operated with a voltage of 1200 V or less, at a frequency between 10 kHz and 300 kHz.

6. The device according to claim 1, wherein the induction coil assembly is operated with a voltage of 1200 V or less, at a frequency between 50 kHz and 200 kHz.

7. The device according to claim 1, wherein the induction coil assembly is operated with a voltage of 1200 V or less, at a frequency between 75 kHz and 125 kHz.

8. The device according to claim 1, wherein the induction coil arrangement comprises at least one induction coil comprising four windings or less.

9. The device according to claim 1, wherein the induction coil assembly comprises at least one induction coil comprising two parallel windings with a common current draw.

10. The device according to claim 1, wherein the induction coil assembly comprises a first induction coil and at least one second induction coil, wherein:

the first induction coil and the second induction coil are arranged such that both induction coils serve to melt off the electrode; or the first induction coil is arranged such that it serves to melt off the electrode, and the second induction coil is arranged downstream of the first induction coil and is arranged such that it serves to heat the melt jet; or the first induction coil is arranged such that it serves to melt off the electrode, and the second induction coil is arranged upstream of the first induction coil and is arranged such that it serves to preheat the electrode to be melted off.

11. The device according to claim 1, wherein the induction coil assembly has an average coil diameter of 50 mm or more.

12. A method for producing an investment casting component, comprising:

providing an electrode in a melting chamber by an electrode charger disposed upstream of the melting chamber;

inserting the electrode, at least in sections, into an induction coil assembly disposed in the melting chamber;

generating a ceramic-free, continuous melt jet with a melt flow rate (MFR) of at least 2.5 kg/min by feeding the electrode with the electrode charger and melting off the electrode by means of the induction coil assembly;

providing an investment casting mold in a casting chamber downstream of and connected to the melting chamber; and continuously filling the investment casting mold with the melt jet.

13. The method according to claim 12, wherein the induction coil assembly is operated at a power (P) for which the following condition is satisfied:

$$P[\mathrm{kW}] \geq 5\left[\mathrm{kW}\cdot\frac{\mathrm{min}}{\mathrm{kg}}\right]\cdot MFR.$$

14. The method according to claim 12, wherein by means of the induction coil assembly the melt jet is superheated as a function of the melt flow rate (MFR) such that the superheating temperature ($T_{sup}$) satisfies the following condition:

$$T_{sup}[^\circ\ \mathrm{C.}] \geq 5\left[^\circ\ \mathrm{C.}\cdot\frac{\mathrm{min}}{\mathrm{kg}}\right]\cdot MFR.$$

15. The method according to claim 12, wherein the melt jet is superheated by means of the induction coil assembly by at least 10° C.

16. The method according to claim 12, wherein the induction coil assembly is operated at a voltage of 1200 V or less and at a frequency between 10 kHz and 300 kHz.

17. The method according to claim 12, wherein the induction coil assembly is operated at a voltage of 1200 V or less and at a frequency between 50 kHz and 200 kHz.

18. The method according to claim 12, wherein the induction coil assembly is operated at a voltage of 1200 V or less and at a frequency between 75 kHz and 125 kHz.

19. The method according to claim 12, wherein at least the melting chamber is pressurized with an absolute pressure of at least 30 mbar so that the melt jet is generated under this absolute pressure.

20. A device for producing an investment casting component, comprising:

a melting chamber comprising an induction coil assembly disposed in the melting chamber and adapted to melt off an electrode at least partially received therein to produce a ceramic-free continuous melt jet with a melt flow rate (MFR) of at least 2.5 kg/min;

an electrode charger disposed upstream of the melting chamber and adapted to displace the electrode along its longitudinal axis in the direction of the induction coil assembly; and a casting chamber downstream of the melting chamber and connected thereto and comprising an investment casting mold received or receivable therein for being filled by means of the ceramics-free continuous melt jet;

wherein the induction coil assembly is arranged to superheat the melt jet in dependence on the melt flow rate (MFR) such that the superheat temperature ($T_{sup}$) satisfies the following condition:

$$T_{sup}[^\circ\,\mathrm{C.}] \geq 5\left[^\circ\,\mathrm{C.}\cdot\frac{\mathrm{min}}{\mathrm{kg}}\right]\cdot MFR.$$

* * * * *